US007859499B2

(12) United States Patent
Furukawa

(10) Patent No.: US 7,859,499 B2
(45) Date of Patent: Dec. 28, 2010

(54) DISPLAY APPARATUS

(75) Inventor: Tomoo Furukawa, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 832 days.

(21) Appl. No.: 11/814,108

(22) PCT Filed: Jan. 19, 2006

(86) PCT No.: PCT/JP2006/300765

§ 371 (c)(1),
(2), (4) Date: Jul. 17, 2007

(87) PCT Pub. No.: WO2006/080237

PCT Pub. Date: Aug. 3, 2006

(65) Prior Publication Data

US 2009/0002298 A1 Jan. 1, 2009

(30) Foreign Application Priority Data

Jan. 26, 2005 (JP) ..... 2005-018754

(51) Int. Cl.
*G09G 3/36* (2006.01)

(52) U.S. Cl. ..... 345/88

(58) Field of Classification Search ..... 345/76–83, 345/88, 89, 690; 348/254, 674
See application file for complete search history.

(56) References Cited

U.S. PATENT DOCUMENTS 5,929,843 A 7/1999 Tanioka (Continued)

FOREIGN PATENT DOCUMENTS

JP 11-098521 A 4/1999

(Continued)

OTHER PUBLICATIONS

Official Communication for PCT Application No. PCT/JP2006/300765; mailed on Apr. 18, 2006.

*Primary Examiner*—Quan-Zhen Wang
*Assistant Examiner*—Tom V Sheng
(74) *Attorney, Agent, or Firm*—Heating & Bennett, LLP

(57) ABSTRACT

A display apparatus includes a luminance compressing section, a luminance extending section, and a W calculating section. The luminance compressing section subjects three color signals to luminance compression according to a luminance in a preceding frame, and outputs compressed color signals. The luminance extending section outputs luminance extended and converted color signals of respective three colors. Each of the luminance extended and converted color signals is obtained by subtracting a corrected minimum luminance value from a luminance extended color signal which is obtained by subjecting the compressed color signal to luminance extension at a luminance extending rate S in accordance with a function F(t). The function F(t) has as a variable a ratio t of a minimum luminance value to a maximum luminance value of the compressed color signals. The corrected minimum luminance value is obtained by multiplying the minimum luminance value by a coefficient k. The W calculating section outputs the minimum luminance value as a white signal. The function F(t) has a constant according to light emitting efficiencies of four color picture elements. The coefficient k is set so that a luminance of the W (white) color signal becomes equal to or less than a minimum luminance of the luminance extended and converted color signals of the three colors.

16 Claims, 5 Drawing Sheets

U.S. PATENT DOCUMENTS

| | | | | |
|---|---|---|---|---|
| 6,724,934 | B1 | 4/2004 | Lee et al. | |
| 6,750,874 | B1 * | 6/2004 | Kim | 345/600 |
| 7,483,011 | B2 * | 1/2009 | Yang et al. | 345/88 |
| 2003/0151694 | A1 | 8/2003 | Lee et al. | |
| 2004/0046725 | A1 | 3/2004 | Lee | |
| 2004/0222999 | A1 | 11/2004 | Choi et al. | |
| 2006/0181553 | A1 * | 8/2006 | Choe et al. | 345/690 |
| 2007/0052984 | A1 * | 3/2007 | Jeong et al. | 358/1.9 |

FOREIGN PATENT DOCUMENTS

| | | | |
|---|---|---|---|
| JP | 2004-286814 | A | 10/2004 |
| WO | 01/37249 | A2 | 5/2001 |

* cited by examiner

| | | | |
|---|---|---|---|
| R | W | R | W |
| G | B | G | B |
| R | W | R | W |
| G | B | G | B |

| | | | | | | | |
|---|---|---|---|---|---|---|---|
| R | G | B | W | R | G | B | W |
| R | G | B | W | R | G | B | W |

DISPLAY APPARATUS

BACKGROUND OF THE INVENTION

1. Field of the Invention

The present invention relates to a display apparatus such as a color liquid crystal display apparatus that is capable of displaying a sharp color image by adjusting a luminance of the image while maintaining a hue of the image.

2. Description of the Related Art

A conventional color liquid crystal display apparatus generally includes three pixels for each dot. However, a recently proposed color liquid crystal display includes four pixels (RGBW) for each dot. In other words, a white (W) pixel has been added to the three pixels for each dot in the conventional color liquid crystal display for the purpose of improving luminance. This RGBW color liquid crystal display is advantageous in improvement of luminance. However, this RGBW color liquid crystal display tends to cause reduced color saturation. Accordingly, it is necessary to carefully consider how to determine an output tone and an arrangement of the W pixel.

For example, Japanese Unexamined Patent Publication No. 102292/2004 (Tokukai 2004-102292) (published on Apr. 2, 2004, and hereinafter referred to as Patent Document 1) discloses a W pixel arrangement. Patent Document 1 proposes to reduce a size of a W pixel so that the size becomes smaller than respective sizes of the RGB pixels. This proposal is intended to prevent the occurrence of reduced color saturation caused by a display signal of the W pixel.

Patent Document 1 also discloses that input RGB data is converted into RGBW data, and then the RGBW data thus converted is further converted into an optimum data R', G', B', and W'. Although Patent Document 1 does not specifically explain how to convert RGB data into RGBW data, the further data conversion of the RGBW data into the R' G' B' W' data is intended to improve luminance and to maintain color saturation at the same time.

However, the more the size of the W pixel is reduced so that the size becomes smaller than the respective sizes of the RGB pixels, the more an effect of improvement in luminance is damaged. In an embodiment of Patent Document 1, a 50% increase in luminance is found but this is found only when all RGBW pixels have identical sizes. However, for example, in a case where R, G, and B are 1.05 and W is 0.85 under an assumption that an original size of each color pixel is 1, an increase in luminance is no more than approximately 42%. Moreover, a computing process in a drive circuit is further increased when carrying out two-step conversions, i.e., (1) a first step conversion of RGB input signals into RGBW signals, and (2) a second step conversion of the RGBW signals into an R'G'B'W' signals. This causes an increase in a circuit size, and in the cost of the circuit.

Japanese Unexamined Patent Publication 241551/1993 (Tokukaihei 5-241551) (published on Sep. 21, 1993, and hereinafter referred to as Patent Document 2) discloses a simplest and easiest arrangement for calculating RGBW signals from RGB signals. This arrangement is characterized by including: means for extracting a white signal from a plurality of input color component signals (min detecting section 1); and means for outputting four color display signals including at least a white color display signal, in response to the extracted white color signal and the plurality of color component signals. Moreover, the method in Patent Document 2 is characterized by further including means for carrying out a nonlinear conversion with respect to the extracted white signal, and for outputting a display signal in response to (i) the plurality of color component signals and (ii) the white signal thus non-linearly converted.

In this method, the white signal W is extracted as a minimum value of the RGB signals, and the non-linear conversion of W into W' is performed according to need. In the method, the following calculations are carried out.

$$\mathrm{OUT}(R,G,B)=\mathrm{IN}(R,G,B)-\mathrm{OUT}(W)$$

$$\mathrm{OUT}(W)=W \text{ or } W'$$

According to this method, any one of RGB outputs inevitably becomes 0 if W is not subjected to the non-linear processing. Particularly when white or gray color is displayed, both of the equations Rout=Gout=Bout=0 and W=min (Rin, Gin, and Bin) are satisfied. Accordingly, with this method, luminance is not improved, and, moreover, the occurrence of reduced color saturation becomes significant. If the non-linear processing is carried out with respect to W so that W is converted into W', a problem of the occurrence of reduced color saturation is solved to a certain extent. However, this does not lead to improvement of luminance, because luminance of an input signal is not extended.

A more complex method of calculating RGBW signals from RGB signals is disclosed, for example, in Japanese Unexamined Patent Publication 119714/2001 (Tokukai 2001-119714) (published on Apr. 27, 2001, and hereinafter referred to as Patent Document 3). Patent Document 3 proposes a method of obtaining a white signal component. The method includes the steps of (i) finding an increased luminance amount for each of fundamental color components each constituting a predetermined color signal, (ii) extracting an increased luminance amount of a white color signal component from the increased luminance amounts of the fundamental color components, and (iii) setting the increased luminance amount of the white signal component as a white signal component of the predetermined color signal.

A specific method that Patent Document 3 discloses is explained below with reference to FIG. 7. In FIG. 7, for simplification, only two signals of R and G are taken into consideration. For example, in a case where R is a minimum luminance signal Lmin and G is a maximum luminance signal Lmax, color A is extended to a maximum luminance A' which is an extension of OA. Color C having the same R to G luminance ratio as the color A is also subjected to luminance extension performed with a luminance extending rate S=OA'/OA. Similarly, a luminance extending rate S=OB'/OB is applied to color D. A relationship between a luminance extending rate S and t (=Lmin/Lmax) becomes as shown in FIG. 8.

However, the conventional invention disclosed in Patent Document 3 has a problem that displayed image quality deteriorates. Namely, in the conventional invention, color saturation of a primitive color looks reduced when the primitive color is adjacent to white color. This is because luminance of primitive colors is not extended at all. This results in the problem of deterioration in image display quality. Moreover, as illustrated in FIG. 8, the luminance extending rate S is saturated at t=0.5 and a curve of the luminance extending rate S is turned. This causes a pattern where an image looks unnatural, thereby presenting the problem of deterioration in display image quality.

SUMMARY OF THE INVENTION

In order to overcome the problems described above, preferred embodiments of the present invention provide a display apparatus that is (i) capable of displaying a sharp color image by adjusting a luminance of the image while maintaining a hue of the image, and (ii) capable of improving image display quality.

A display apparatus according to a preferred embodiment of the present invention is a display apparatus for displaying an image with the use of a plurality of pixels arranged in a matrix, each of the pixels including four color picture elements, an R (red) picture element, a G (green) picture element, a B (blue) picture element, and a W (white) picture element, the display apparatus including: a luminance compressing section generating and outputting compressed color signals which are obtained by respectively compressing luminances of incoming three color signals, red, green, and blue, in accordance with a luminance of a preceding frame; a luminance extending section (i) generating luminance extended color signals by respectively extending luminances of the compressed color signals at a luminance extending rate S obtained on the basis of a function F(t) having a ratio t ($0 \leqq t \leqq 1$) as a variable, where the ratio t is a ratio of a minimum luminance value to a maximum luminance value in the compressed color signals, and (ii) outputting luminance extended and converted color signals of the three colors, the luminance extended and converted color signals each being obtained by subtracting, from each of the luminance extended color signals, a corrected minimum luminance value obtained by multiplying the minimum luminance value by a coefficient k; and a W (white) calculating section that outputs the minimum luminance value as a W (white) color signal for the W (white) picture element, wherein the coefficient k is set so that a luminance of the W (white) color signal becomes equal to or less than a minimum luminance of the luminance extended and converted color signals of the three colors.

A display apparatus according to another preferred embodiment of the present invention, is a display apparatus for displaying an image with the use of a plurality of pixels arranged in a matrix, each of the pixels including four color picture elements, an R (red) picture element, a G (green) picture element, a B (blue) picture element, and a W (white) picture element, the display apparatus including: a luminance compressing section generating and outputting compressed color signals which are obtained by respectively compressing luminances of incoming three color signals, red, green, and blue, in accordance with a luminance of a preceding frame; a determination section determining a ratio t ($0 \leqq t \leqq 1$) that is a ratio of a minimum luminance value to a maximum luminance value in the compressed color signals; a luminance extending section (i) generating luminance extended color signals by respectively extending luminances of the compressed color signals at a luminance extending rate S obtained on the basis of a function F(t) having the ratio t as a variable, and (ii) outputting luminance extended and converted color signals of the three colors, the luminance extended and converted color signals each being obtained by subtracting, from each of the luminance extended color signals, a corrected minimum luminance value obtained by multiplying the minimum luminance value by a coefficient k; and a W (white) calculating section that outputs the minimum luminance value as a W (white) color signal for the W (white) picture element, wherein the coefficient k is set so that a luminance of the W (white) color signal becomes equal to or less than a minimum luminance of the luminance extended and converted color signals of the three colors.

According to this unique arrangement, a minimum luminance value is assumed to be a W (white) color signal for a W (white) picture element. The luminance extended and converted color signals are outputted for an R (red) picture element, a G (green) picture element, and a B (blue) picture element. Each of the luminance extended and converted color signals is obtained by subtracting, from each of the luminance extended color signals, a corrected minimum luminance value obtained by multiplying the minimum luminance value by a coefficient k. Accordingly, four color signals including the W (white) color signal and the luminance extended and converted color signals are generated from three color signals and outputted. This enables improvement in the luminance by adding the W (white) signal and at the same time prevention of reduction in color saturation of each reproduced color, which reduction is caused by the luminance extended and converted color signals. As a result, display quality can be improved.

Moreover, according to this unique arrangement, each of the three color signals previously subjected to luminance extension is subjected to luminance compression in accordance with a luminance of a preceding frame. Therefore, by varying a compression ratio in accordance with a scene corresponding to a preceding frame in image display, it becomes possible to perform optimum luminance extension in accordance with a scene of an image. This allows luminances of primitive colors to be extended to a certain extent. This provides an advantage that reduction in color saturation of a primitive color can be suppressed to a minimum even in a case where the primitive color comes adjacent to white color. As a result, display quality can be improved.

Furthermore, in the arrangement, the coefficient k is set so that the luminance of the W (white) color becomes equal to or less than a minimum luminance of the luminance extended and converted signals of the three colors. The coefficient k is used to obtain a corrected minimum luminance value by multiplying the minimum luminance value by the coefficient k. This enables prevention of the occurrence of a white spot particularly during gray display and to improve display quality.

Other features, elements, steps, characteristics and advantages of the present invention will be described below with reference to preferred embodiments thereof and the attached drawings.

DETAILED DESCRIPTION OF PREFERRED EMBODIMENTS

Figure 1:
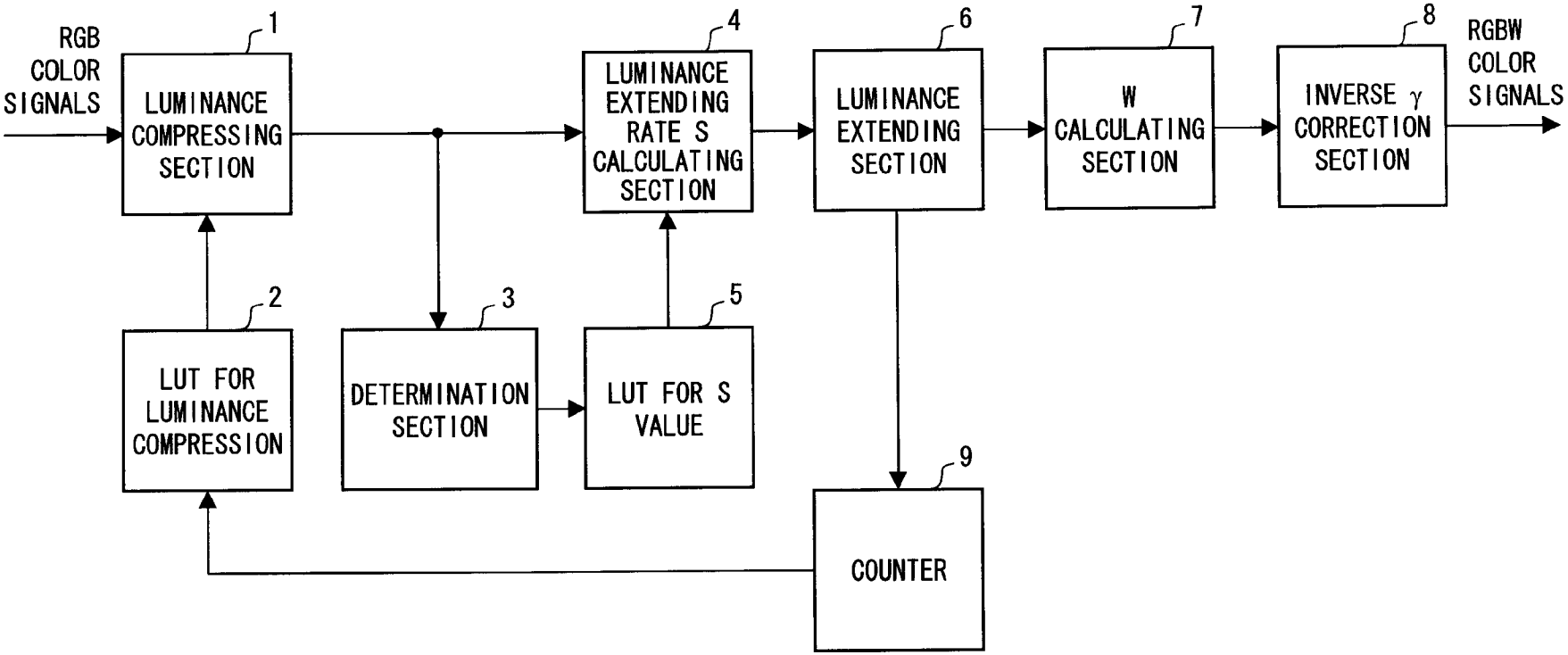
FIG. 1 is a block diagram of a substantial portion of a liquid crystal display apparatus according to a preferred embodiment of the present invention.

Preferred embodiments of a liquid crystal display according to a display apparatus of the present invention is explained below, with reference to FIGS. 1 through 6. An active matrix system using TFTs (Thin Film Transistors) as switching elements is known as a system capable of performing a display of high definition, among various display types of a liquid crystal display apparatus. As illustrated in FIG. 2, a liquid crystal display apparatus 110 employing the active matrix system includes a liquid crystal display section (display section) 110*a* and a liquid crystal drive circuit (drive signal outputting section) 110*b* serving as a liquid crystal driving device that drives the liquid crystal display section 110*a*.

The liquid crystal display section 110*a* includes a TFT-type liquid crystal panel 101. The liquid crystal panel 101 has pixels (dots) arranged in a matrix (lattice). In the present preferred embodiment, for example, pixels are preferably arranged in a matrix of 1024×768 pixels (XGA (eXtended Graphic Alley)). The liquid crystal panel 101 can display an image, by sequentially or intermittently scanning a horizontal scanning line (line) in a vertical direction in accordance with an image signal. In a case of the XGA, there are 768 horizontal scanning lines in total. One horizontal scanning line corresponds to 1024 pixels. The number of pixels arranged in an array may be, according to need, 1280×1024 pixels (SXGA (Super XGA)), 1600×1200 pixels (UXGA (Ultra XGA)), 3200×2400 pixels (2.7p/j), or the like. Other than a screen having a screen ratio of 4:3 as mentioned above, a wide screen may be used. Examples of the wide screen are Full High Definition (1920×1080) and WXGA (Wide XGA) (1366×768).

Figures 3, 4, 5:
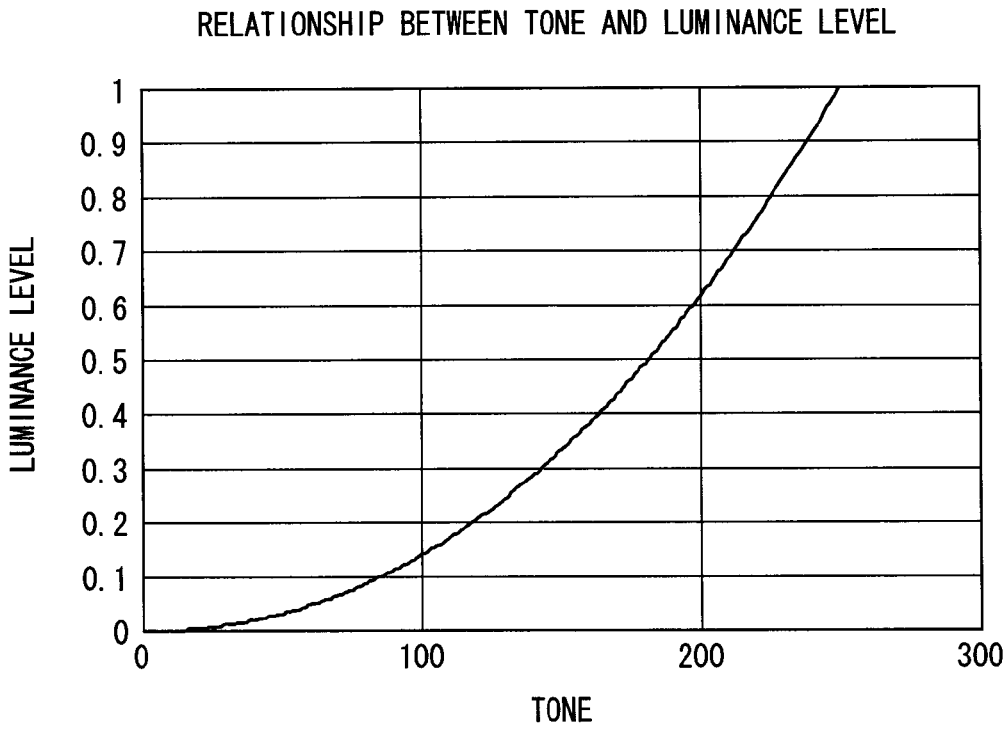
FIG. 3 is a plan view illustrating an arrangement of picture elements of the liquid crystal display apparatus.
FIG. 4 is a plan view illustrating another arrangement of picture elements of the liquid crystal display apparatus.
FIG. 5 is a graph showing a relationship between a tone of each color signal and a luminance level in the liquid crystal display apparatus.

As illustrated in FIG. 3, each of the pixels (dots) arranged in a matrix has four color picture elements including an R (Red) picture element, a G (Green) picture element, a B (Blue) picture element, and a W (White) picture element. The four color picture elements are arranged in an array of two picture elements (pixel)×two picture elements. In the R picture element, the G picture element, and the B picture element, corresponding color filters (not shown) are attached to a light transmitting glass substrate. For the W (White) picture element, the light transmitting glass substrate is provided with no filter. The four color picture elements may employ an arrangement such as a four color striped arrangement as illustrated in FIG. 4, a mosaic-type arrangement (not shown), or a delta-type arrangement (not shown).

Although not shown in the drawings, a backlight is provided as a white light source on a backside of the liquid crystal panel 101. The liquid crystal drive circuit 110*b* includes a source driver (drive circuit) 103 and a gate driver 104 which are made of an IC (Integrated Circuit), a controller (control circuit, drive circuit) 105, and a liquid crystal drive power source 106. The controller 105 can control a luminance of the backlight so that the luminance is adjusted to a maximum luminance of an image signal for each frame or for a plurality of (5 to 6) frames.

According to the arrangement, an image signal externally inputted for color display is supplied to the source driver 103 via the controller 105 as display data D that is a digital signal. The source driver 103 carries out a time-division with respect to the display data D thus received, and latches, at the first to the nth source drivers, the display data D which has been subjected to the time-division. Then, each of the display data D thus latched is subjected to a D/A conversion in synchronization with the horizontal synchronization signal supplied from the controller 105. A luminance component of each color in the image signal is tone data. The tone data is generally subjected to γ correction so that a γ characteristic of a CRT is compensated. Note that preferred embodiments of the present invention are applicable to an image signal that is not subjected to the γ correction, because preferred embodiments of the present invention are preferably arranged to convert three color signals into four color signals.

By carrying out the D/A conversion with respect to the display data D which is thus subjected to the time-division, analog display data signals are prepared. Each of the analog display data signals is an analog voltage for tone display (hereinafter, referred to as "tone display voltage"). The analog display data signals are outputted to corresponding liquid crystal display elements (pixels) in the liquid crystal panel 101 via source signal lines (not shown), respectively.

Further, the controller 105 outputs, to each source driver in the source driver 103, (i) color signals (R, G, and B), (ii) a horizontal synchronization signal (equivalent to a start pulse signal SP and a latch signal Ls) serving as a controller signal, and (iii) a clock signal clk. The controller 105 also outputs, to each gate driver in the gate driver 104, (i) a vertical synchronization signal and (ii) a horizontal synchronization signal. The controller 105 also includes, for example, an I/O circuit, a display RAM in which the image signal is stored, a generation circuit and an output circuit each for the various control signals.

Figure 2:
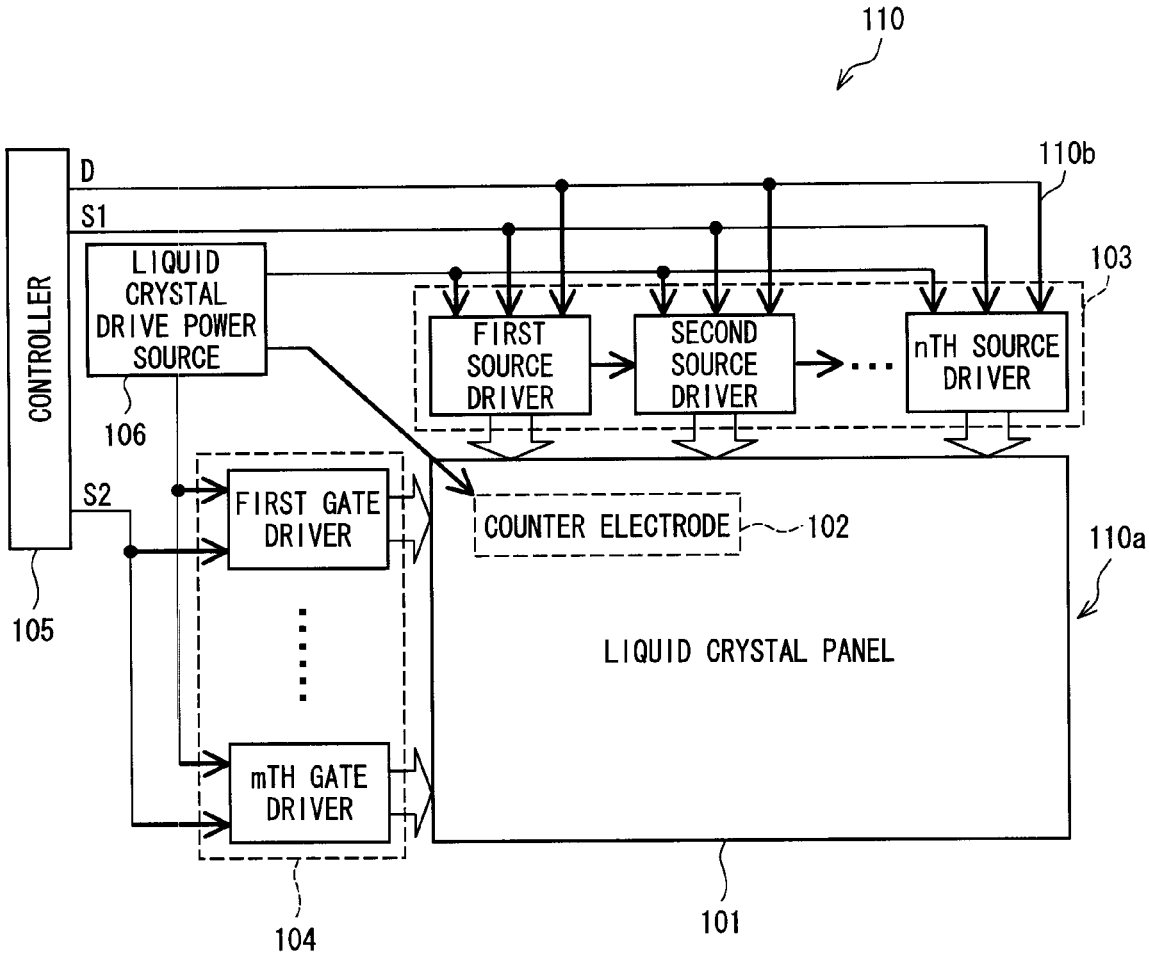
FIG. 2 is a block diagram schematically illustrating the liquid crystal display apparatus.
Figure 6:
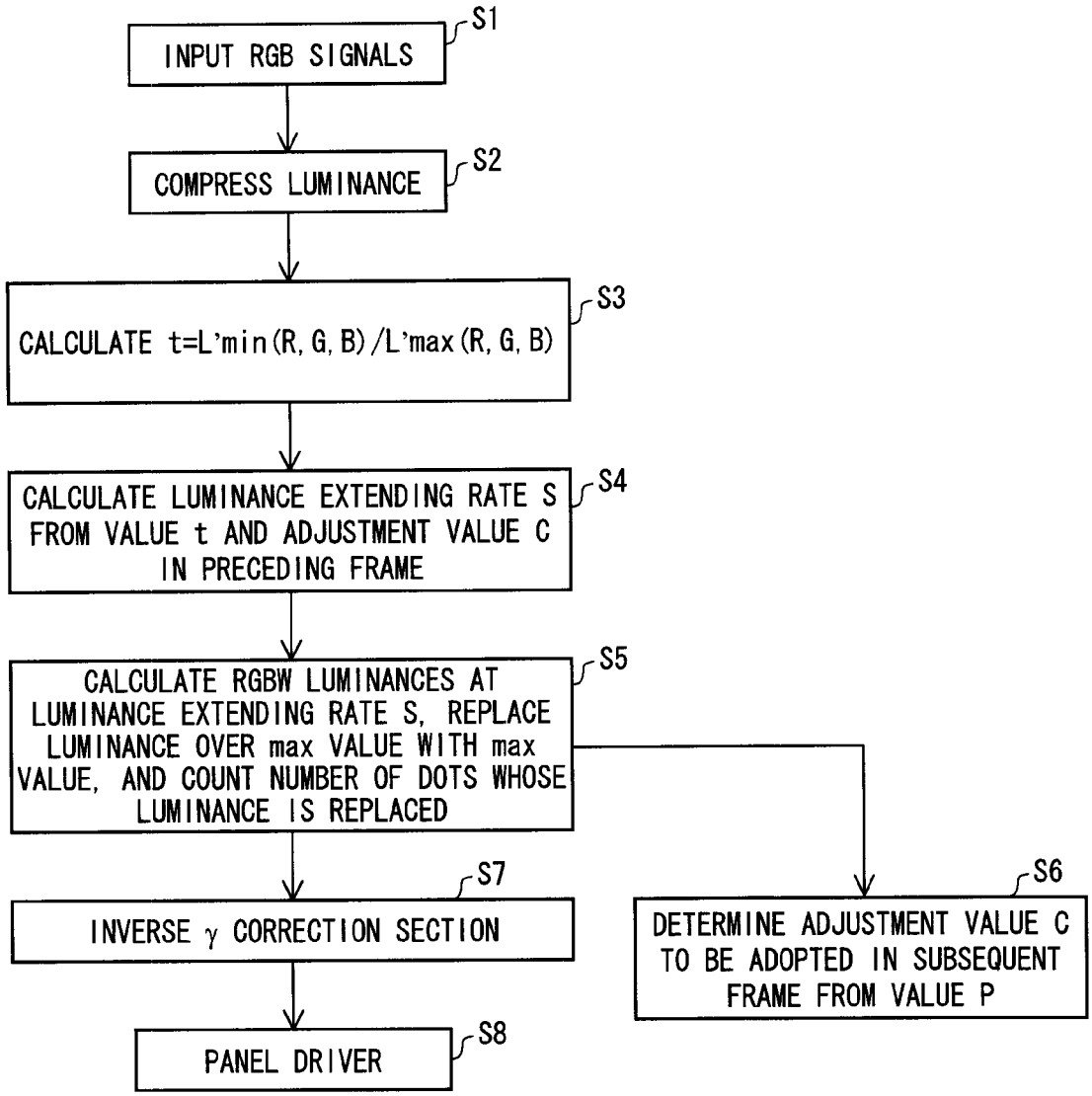
FIG. 6 is a flow chart illustrating a process for converting three colors to four colors in the liquid crystal display apparatus.
Figure 7:
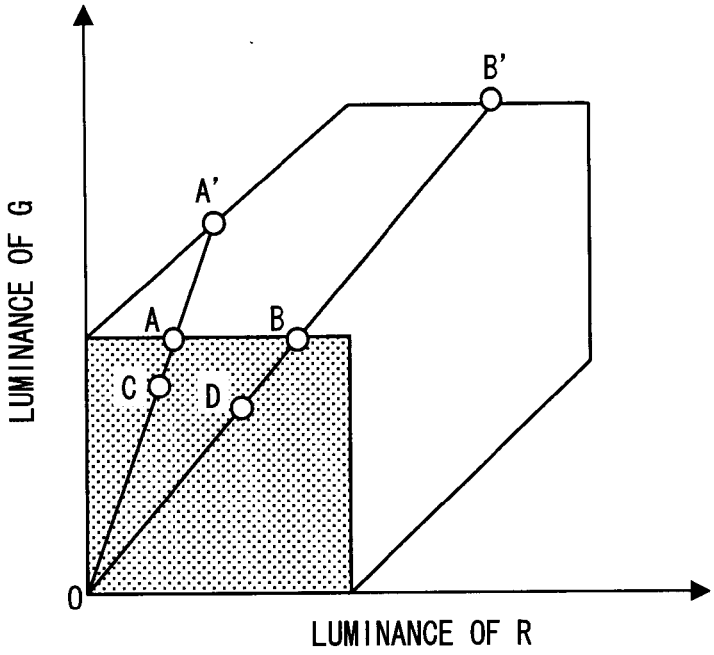
FIG. 7 PRIOR ART
FIG. 7 is a graph showing a conventional process for converting three colors to four colors.
Figure 8:
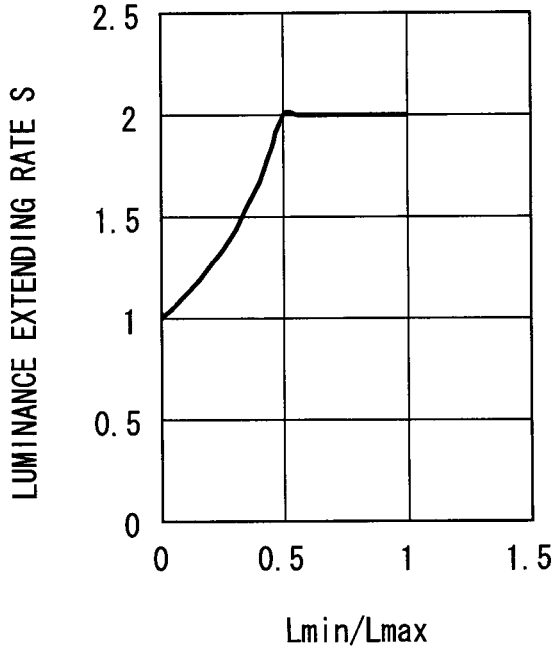
FIG. 8 PRIOR ART
FIG. 8 is a graph showing another conventional process for converting three colors to four colors.

In a liquid crystal display apparatus according to a preferred embodiment of the present invention and a method for converting three color signals into four color signals using the apparatus, as illustrated in FIGS. 1 and 6, a luminance compressing section 1 is provided (i) for receiving each of red, green and blue color signals (tone data) (Step 1, hereinafter, referred to as S1), and (ii) for compressing the luminance of the tone data of each the color signals (S2) in accordance with a value of total luminance of an image signal in a preceding frame (whether the value is larger than a preset value or equal to or less than the preset value). A lookup table (LUT) 2 for luminance compression is also provided as a reference table which the luminance compressing section 1 uses when carrying out the luminance compression. The number of tones in the tone data may be, for example, 28 tones, namely, 256 tones (0th tone to 255th tone). Alternately, the number of tones may be 210 tones, namely, 1024 tones. In the LUT 2 for luminance compression, converted data, obtained by performing the luminance compression, has been stored for each adjustment value C explained later. Data corresponding to an adjustment value C is read out and outputted from the LUT 2 in accordance with the adjustment value C.

An example of such luminance compression is expressed by L'(R, G, B)=Lin(R, G, B)*C/1.35, where: * indicates multiplication; Lin(R, G, B) indicates tone data of each color signal which has not been subjected to luminance compression; and L'(R, G, B) indicates tone data of each compressed color signal which has been subjected to the luminance compression. In this preferred embodiment, the adjustment value C does not change continuously, but is preferably set to change stepwise by, for example, about 0.05. Accordingly, the luminance compression preferably has 8 levels, for example. The number of the levels may be 4 levels or 16 levels, according to need.

In this luminance compression, tone data is subjected to bit extension (for example, extension from 28 tones to 29 tones), and then subjected to the luminance compression. The bit extension is performed so as to prevent the tone data from being lost due to the luminance compression. An output after the luminance compression becomes bit-extended tone data.

In the present preferred embodiment of the present invention, a determination section 3 is preferably provided. Here, it is assumed that, in compressed color signals L'(RGB) in one dot which have been subjected to luminance compression as mentioned above, a minimum value of luminance is min L'(R, G, B) and a maximum value of the luminance is max L'(R, G, B). The determination section 3 finds min L'(R, G, B) and max L'(R, G, B). Then, the determination section 3 determines a ratio t ($0 \leqq t \leqq 1$), namely, t=min L'(R, G, B)/max L'(R, G, B), and outputs the ratio t (S3). This preferred embodiment includes a case where min L'(R, G, B)=max L'(R, G, B). The determination section 3 may calculate the ratio. Alternately, a luminance extending rate S calculating section 4 or a luminance extending section 6 explained later may carry out the calculation. In such a case, the determination section 3 is dispensable.

In the present preferred embodiment, a luminance extending rate S calculating section 4 is preferably provided. The luminance extending rate S calculating section 4 calculates a luminance extending rate S with the use of a value of the ratio t (S4). A LUT 5 for an S value is further provided for the calculation of the luminance extending rate S. In the LUT 5 for an S value, converted data is stored beforehand which has been subjected to luminance extension in accordance with the luminance extending rate S. The converted data is read out and outputted from the LUT 5 in accordance with a ratio t of a maximum luminance value and a minimum luminance value of each of the compressed color signals L'(RGB) which have been subjected to the luminance compression. Any memory is usable as the LUT 2 for luminance compression and the LUT 5 for an S value, provided that the memory fits to the specifications of the LUT 2 and the LUT 5. One example of such a memory is a dual port random access memory (Dpram).

An equation for calculating the rate S may be expressed by a quadratic function such as S=a*t2+b*t+Cmax. The Cmax in the aforesaid calculating equation is preferably set to about 1.35 in the present preferred embodiment. The Cmax is preferably set to about 1.35 on the basis of an actual evaluation result as follows. In a case of t=0, namely, when the color is any single color of R, G, and B, the luminance extending rate S becomes S=Cmax=1.35 according to the aforesaid calculating equation. However, actually, when S is over 1.35 and a luminance ratio between the single color and white color becomes large, the single color appears to be a dim color.

In other words, by changing a three color RGB arrangement to a four color RGBW arrangement, a maximum luminance of each of RGB picture elements becomes about 0.75 times as large as the original maximum luminance of the each. Accordingly, when each of the RGB picture elements intends to have the same luminance as the original luminance, luminance of each of the picture elements R, G, and B is preferably set to about 1.33 times as much. C is equivalent to the luminance extending rate S. Accordingly, Cmax may originally be about 1.33. However, in view of controllability, it is preferable to vary the C stepwise by about 0.05. Therefore, Cmax is preferably set to about 1.35.

A function of the aforesaid calculating equation can be variously changed, according to need. However, in the present preferred embodiment, the function F(t) is preferably set so as to be $F(t+\Delta t)>\{F(t)+F(t+2\Delta t)\}/2$. In other words, a value obtained by the function is a positive number in a case of $0 \leqq t \leqq 1$, and increases monotonously as t increases. Moreover, an increasing rate of the function decreases as t increases. Namely, the function may be a depressed function.

In the present preferred embodiment, it is preferable that the aforesaid function F(t) is set according to, for example, an average transmission rate (light emitting efficiency) Tc of a color filter (CF) of each color (R, G, B) and a transmission rate Tw (light emitting efficiency) of white (W) color. In the present preferred embodiment, assuming that F(t)=a*t2+b*t+1.35 is adopted, it is preferable that the a and b are fixed according to a maximum luminance extending rate m (m=(3Tc+Tw)/3Tc) in accordance with the transmission rates of the CFs so that F(0)=1.35, F(1)=m, and F(0.5)=0.9m are satisfied. This preferable case has a=2.7−1.6m and b=2.6m−4.05.

Furthermore, in the present preferred embodiment, a luminance extending section 6 is preferably provided. The luminance extending section 6 is provided for performing luminance extension, by calculation with the use of L'(R, G, B) and a luminance extending rate S, to obtain Lout (R, G, B) from L'(R, G, B), and for outputting the Lout (R, G, B) as luminance extended and converted signals of respective three colors (R, G, B) (S5). Note that the luminance extending section 6 could include the aforesaid luminance extending rate S calculating section 4. In this case, the luminance extending rate S calculation section 4 becomes dispensable.

A calculating equation may be expressed as Lout (R, G, B)=L'(R, G, B)*S−min (L'(R, G, B))*k. In the calculating equation, L'(R, G, B)*S is the luminance extended color signal of the respective three colors. k is a transmittance ratio of respective colors (R, G, B) to white color in the liquid crystal panel 101. The k is a constant particular to the liquid crystal panel 101, and can be expressed by an equation k=Tw/3Tc with the use of the aforesaid Tc and Tw.

In the present preferred embodiment, a W calculating section 7 is preferably provided. The W calculating section 7 calculates Lout (W) as a W (white) color signal from the aforesaid min L'(R, G, B) which Lout (W) is an output of white color, and outputs the Lout (W) (S5). In the present preferred embodiment, Lout (W) is preferably set to be equal to min L'(R, G, B). In the present preferred embodiment, the provision of the luminance compressing section 1, the luminance extending section 6, and the W calculating section 7 allows the luminance of the W (white) color signal to be set so that the luminance of the W color signal is equal to a minimum luminance (at t=1) or less than the minimum luminance (at $0 \leqq t<1$) in the luminance extended and converted color signals of the respective three colors. Moreover, by setting k to be k=Tw/3Tc, the coefficient k can be set so that an increase, caused by extension with the luminance extending rate S, in each of the luminance extended color signals are cancelled at t=1.

In the present preferred embodiment, an inverse γ correction section 8 is preferably provided to subject the processed four color signals after luminance extension to inverse γ correction (conversion from tone to luminance) and to output corrected signals in accordance with a γ characteristic of the liquid crystal panel 101 (S7). The inverse γ correction section 8 may have γ ranging from about 2.4 to about 2.6 in order to further sharpen an image to be displayed. One example of a relationship between a tone and a luminance level in the inverse γ correction section 8 is illustrated in FIG. 5.

Moreover, in the present preferred embodiment, a counter 9 is provided. The counter 9 counts the number of pixels having tone higher than 255th tone that is a maximum tone, for each color of R, G, and B in one frame, as a result of the luminance extension at the luminance extending section 6. When the number of pixels having tone higher than 255th tone for each color exceeds, for example, about 2% of the total number of dots, the counter 9 sets a count-over flag for each color (R0V, G0V, B0V) (S5). The counter 9 sets a count 0 flag for each color (R00, G00, B00) when the number of pixels having tone higher than 255th tone is 0. The lower value of the predetermined number is preferably about 1% of the total number of dots, more preferably about 1.2%, further more preferably about 1.5%. The upper value of the predetermined number is preferably about 10% of the total number of dots, more preferably about 6%, further more preferably about 4%.

The counter 9 sets the adjustment value C of the subsequent frame to be C=C−0.05, namely, subtracts 0.05 from the adjustment value C used in a preceding frame, if a flag is set on at least one of R0V, G0V, and B0V (1). On the other hand, the counter sets the adjustment value C of the subsequent frame to be C=C+0.05, namely, adds 0.05 to the adjustment value C used in a preceding frame, if flags are set on all of R00, G00, and B00(1). For cases other than the aforesaid cases, the counter 9 does not change the adjustment value C of the subsequent frame from the preceding frame. In this way, in the present preferred embodiment, the adjustment value C has 8 level variations (S6).

In the present preferred embodiment, luminance-to-tone conversion (conversion from luminance to tone) is carried out by the subsequent inverse γ correction section 8. Alternately, the luminance-to-tone conversion can be carried out by the luminance compressing section 1. However, because the luminance extending rate S calculating section 4 reads the LUT 5 for an S value in calculating the luminance extending rate S, it is more convenient that a read address is a tone data address. Moreover, if the luminance-to-tone conversion is carried out by the luminance compressing section 1, the calculation carried out by the luminance extending rate S calculating section 4 becomes complex. Accordingly, it is more preferable that the subsequent inverse γ correction section 8 includes the luminance-to-tone converting function.

The effects of the present preferred embodiment of the present invention will be explained in the following. In the present preferred embodiment, a luminance extension curve is fixed to one curve. However, the luminance is temporarily compressed before the luminance extension is performed, and a compression rate is changed according to a scene. This allows an optimum luminance extension to be performed in accordance with an image scene. Therefore, a primitive color can be subjected to luminance extension to a certain extent. Consequently, in a case where a primitive color and white color are adjacent to each other, the present preferred embodiment is advantageous in that reduction in color saturation of the primitive color can be suppressed to a minimum.

In the present preferred embodiment, a W component is subtracted from the RGB signals that have been subjected to luminance extension. This makes it possible to suppress reduction in color saturation to the minimum which reduction is caused by application of the W signal. Moreover, when t=1 (namely, gray display or white display in which luminances of RGB are equal to each other), the luminance of W can be arranged to be the same as each of the luminances of RGB. This allows a white (light) spot to be prevented during gray display. Accordingly, display quality is improved.

Furthermore, because the luminance compression ratio of RGB is determined according to color-specific luminance information, it becomes possible to calculate an optimum luminance compression ratio in accordance with a scene. With the result of the aforesaid calculation of the luminance compression ratio, optimum luminance extension can be carried out in accordance with the scene.

The following explains a difference between the present preferred embodiment and Patent Document 1. In Patent Document 1, both of (i) improvement of luminance and (ii) maintenance of color saturation are intended by reducing a size of a W pixel to be smaller than those of RGB pixels. However, in the present preferred embodiment, an optimum luminance extension ratio is calculated for the calculation of RGBW input signals from RGB input signals. This can prevent loss in increased luminance, which loss is caused by reduction in a size of a W pixel.

The following explains a difference between the present invention and Patent Document 2. In Patent Document 2, a white component is extracted from input signals and simply subtracted from the input signals. This causes problems such that (i) luminance extension cannot be carried out, and (ii) reduced color saturation cannot be prevented. Although Patent Document 2 discloses an arrangement of subjecting only the white component to non-linear processing, input RGB signals themselves are not subjected to luminance extension in the arrangement. Therefore, an increase in luminance of a display cannot be expected.

On the other hand, in the present preferred embodiment, luminances of input signals are temporarily compressed. A white component is extracted from the luminance compressed input signals. Then, the white component is subtracted from the input signals after the luminance compressed signals are subjected to luminance extension. This allows a luminance of a single color (namely, a primitive color) to be extended. This also allows reduction in color saturation to be suppressed. Moreover, luminance compression and luminance extension are simply carried out with respect to the input signals, whereas nonlinear data processing is avoided.

The following explains a difference between the present preferred embodiment and Patent Document 3. In Patent Document 3, a luminance extending rate is calculated for each color separately. Meanwhile, in the present preferred embodiment, luminance extending rates for RGB are identical to each other. Moreover, whereas a primitive color cannot be extended at all in Patent Document 3, a primitive color also can be extended to a certain extent in the present preferred embodiment.

Explained below are examples of conversion from RGB signals to RGBW signals. First, shown below is a result of each conversion from (Rin, Gin, Bin)=(255, 128, 64).

According to Patent Document 3 (calculation with γ=2.2), (Rout, Gout, Bout, Wout)=(255, 117, 16, 64) is obtained.

According to Patent Document 2, without nonlinear processing with respect to W, (Rout, Gout, Bout, Wout)=(191, 64, 0, 64) is obtained. (Rout, Gout, Bout, Wout)=(247, 120, 56, 8) is obtained by carrying out non-linear processing as described in the Embodiment of Patent Document 2.

According to another converting method explained later (calculation with γ=2.2), (Rout, Gout, Bout, Wout)=(255, 118, 16, 64) is obtained at C=1. (Rout, Gout, Bout, Wout)=(277, 130, 30, 64) is obtained at C=1.2. Moreover, (Rout, Gout, Bout, Wout)=(292, 138, 42, 64) is obtained at C=1.35.

In the present preferred embodiment (calculation with γ=2.2), (Rout, Gout, Bout, Wout)=(255, 120, 36, 55) is obtained at C=1. (Rout, Gout, Bout, Wout)=(277, 131, 40, 60) is obtained at C=1.2. Moreover, (Rout, Gout, Bout, Wout)=(292, 138, 42, 64) is obtained at C=1.35.

The following shows results of conversion from (Rin, Gin, Bin)=(128, 128, 128) that indicates a neutral gray color.

According to Patent Document 3 (calculation with γ=2.2), (Rout, Gout, Bout, Wout)=(128, 128, 128, 128) is obtained.

According to Patent Document 2, without nonlinear processing with respect to W, (Rout, Gout, Bout, Wout)=(0, 0, 0, 128) is obtained. (Rout, Gout, Bout, Wout)=(83, 83, 83, 45) is obtained by carrying out non-linear processing as described in the Embodiment of Patent Document 2.

According to another converting method explained later (calculation with γ=2.2), (Rout, Gout, Bout, Wout)=(105, 105, 105, 128) is obtained at C=1. (Rout, Gout, Bout, Wout) =(118, 118, 118, 128) is obtained at C=1.2. Moreover, (Rout, Gout, Bout, Wout)=(128, 128, 128, 128) is obtained at C=1.35.

In the present preferred embodiment (calculation with γ=2.2), (Rout, Gout, Bout, Wout)=(111, 111, 111, 111) is obtained at C=1. (Rout, Gout, Bout, Wout)=(121, 121, 121, 121) is obtained at C=1.2. Moreover, (Rout, Gout, Bout, Wout)=(128, 128, 128, 128) is obtained at C=1.35.

The following shows four color signals obtained by conversion from (Rin, Gin, Bin)=(255, 255, 255) that indicates white color.

According to Patent Document 3 (calculation with γ=2.2), (Rout, Gout, Bout, Wout)=(255, 255, 255, 255) is obtained.

According to Patent Document 2, without nonlinear processing with respect to W, (Rout, Gout, Bout, Wout)=(0, 0, 0, 255) is obtained. (Rout, Gout, Bout, Wout)=(0, 0, 0, 255) is obtained by carrying out non-linear processing as described in the Embodiment of Patent Document 2.

According to another converting method explained later (calculation with γ=2.2), (Rout, Gout, Bout, Wout)=(209, 209, 209, 255) is obtained at C=1. (Rout, Gout, Bout, Wout) =(236, 236, 236, 255) is obtained at C=1.2. Moreover, (Rout, Gout, Bout, Wout)=(255, 255, 255, 255) is obtained at C=1.35.

In the present preferred embodiment (calculation with γ=2.2), (Rout, Gout, Bout, Wout)=(223, 223, 223, 223) is obtained at C=1. (Rout, Gout, Bout, Wout)=(242, 242, 242, 242) is obtained at C=1.2. Moreover, (Rout, Gout, Bout, Wout)=(255, 255, 255, 255) is obtained at C=1.35.

The inventors of preferred embodiments of the present invention have devised the following method of converting color signals as another method of converting RGB signals to RGBW signals. According to the method, first, each input color signal indicating a tone is converted to a processed color signal (L') that indicates a luminance. Then, an output luminance is calculated according to the following equation.

$$Lout(R,G,B)=L'(R,G,B)*S-\min(L'(R,G,B)),$$

$$Lout(W)=\min(L'(R,G,B)),$$

$$S=a*t2+b*t+C,$$

$$t=\min(L'(R,G,B))/\max(L'(R,G,B))$$

This Lout is subjected to inverse γ conversion to obtain a color signal output that indicates a tone of each color of RGBW. C is a constant ranging from about 1 to about 1.35 and varies according to the following condition. Counting is carried out to obtain the number of pixels having tone higher than 255th tone, for each color of R, G, and B in one frame. If the number of pixels having tone higher than 255th tone exceeds about 2% of the total number of dots, C of the subsequent frame will be set to C=C−0.05. If the number of pixels having tone higher than 255th tone is 0, the subsequent frame will be set to C=C+0.05. Under conditions other than the aforesaid conditions, C of the subsequent frame is not varied.

According to this method, a plurality of luminance extension curves are prepared. By using a different luminance extension curve in accordance with a scene, an optimum luminance extension can be performed in accordance with an image scene. Therefore, a primitive color can be extended to a certain extent. The resulting advantage is that reduction in color saturation of a primitive color can be suppressed to a minimum even in a case where a primitive color and white color come adjacent to each other. Moreover, by subtracting a W component from the RGB signals that have been subjected to luminance extension, it becomes possible to suppress reduction in color saturation to the minimum which reduction is caused by application of the W signal.

However, as mentioned above, according to the aforesaid another converting method, in a case where C is not 1.35, tones of RGBW become R=G=B<W at gray or white output. Accordingly, in such a case, a high tone is given by only a W pixel. This can lead to a display having a white (light) spot caused by the W pixel particularly at the neutral gray display. In this way, the additional converting method has caused a disadvantage in display quality.

The over-255th-tone pixel counter does not obtain a condition for varying C, for each color. This can produce a case where the luminance extending rate is suppressed more than necessary. This can cause disadvantages such that image display cannot be sharpened and display image quality deteriorates.

However, in the present preferred embodiment, R=G=B=W is obtained even in a case where gray or white color is outputted. Accordingly, display including a light spot can be prevented. Moreover, the condition for varying C is obtained for each color. This prevents the luminance extending rate from being suppressed more than necessary. As a result, the present preferred embodiment can prevent the occurrence of the above-mentioned disadvantages The additional converting method uses eight luminance extension curves, from which a luminance extension curve that the subsequent frame should have is selected according to luminance information of the present frame. The luminance information of the present frame is obtained by counting RGB pixels altogether.

On the other hand, the present preferred embodiment includes one luminance extension curve. Instead of using the eight luminance extension curves used in the aforesaid additional converting method, eight different luminance compressions are carried out in the present preferred embodiment. One of the unique features of the present preferred embodiment includes selecting a degree of luminance compression to be carried out for the subsequent frame in accordance with luminance information of the present frame.

Moreover, according to preferred embodiments of the present invention, the present frame luminance information is obtained for each of RGB, and flag processing is carried out. Moreover, the luminance extension curve is set to R=G=B=W at white or gray color output. This prevents the occurrence of the white spot during gray display, which white spot occurs in the aforesaid additional converting method. The processing of the present frame luminance information for each color makes it possible to prevent the occurrence of an error in which the luminance extension is suppressed more than necessary.

In the above-described preferred embodiment, a liquid crystal panel is described as an example of a display apparatus. However, the display apparatus is not specifically limited to this example. Any color display apparatus that can perform additive color mixture may be the display section. Examples of such a display apparatus, other than the liquid crystal panel, are a flat panel display such as a luminescent plasma display (PDP) and an electroluminescent display (EL), and a color display apparatus using so-called Braun tube such as CRT (Cathode Ray Tube).

In the PDP, EL, and CRT, light emitting efficiency of a pixel of each color may be used in replacement of transmittance ratios (Tc, Tw) used in the liquid crystal panel 101 including the color filter.

As mentioned above, the display apparatus according to a preferred embodiment of the present invention is a display apparatus for displaying an image with the use of a plurality of pixels arranged in a matrix, each of the pixels including four color picture elements, an R (red) picture element, a G (green) picture element, a B (blue) picture element, and a W (white) picture element, the display apparatus including: a luminance compressing section generating and outputting compressed color signals which are obtained by respectively compressing luminances of incoming three color signals, red, green, and blue, in accordance with a luminance of a preceding frame; a luminance extending section (i) generating luminance extended color signals by respectively extending luminances of the compressed color signals at a luminance extending rate S obtained on the basis of a function F(t) having a ratio t ($0 \leqq t \leqq 1$) as a variable, where the ratio t is a ratio of a minimum luminance value to a maximum luminance value in the compressed color signals, and (ii) outputting luminance extended and converted color signals of the three colors, the luminance extended and converted color signals each being obtained by subtracting, from each of the luminance extended color signals, a corrected minimum luminance value obtained by multiplying the minimum luminance value by a coefficient k; and a W (white) calculating section that outputs the minimum luminance value as a W (white) color signal for the W (white) picture element, wherein the coefficient k is set so that a luminance of the W (white) color signal becomes equal to or less than a minimum luminance of the luminance extended and converted color signals of the three colors.

A display apparatus according to another preferred embodiment of the present invention is a display apparatus for displaying an image with the use of a plurality of pixels arranged in a matrix, each of the pixels including four color picture elements, an R (red) picture element, a G (green) picture element, a B (blue) picture element, and a W (white) picture element, the display apparatus including: a luminance compressing section generating and outputting compressed color signals which are obtained by respectively compressing luminances of incoming three color signals, red, green, and blue, in accordance with a luminance of a preceding frame; a determination section determining a ratio t ($0 \leqq t \leqq 1$) that is a ratio of a minimum luminance value to a maximum luminance value in the compressed color signals; a luminance extending section (i) generating luminance extended color signals by respectively extending luminances of the compressed color signals at a luminance extending rate S obtained on the basis of a function F(t) having the ratio t as a variable, and (ii) outputting luminance extended and converted color signals of the three colors, the luminance extended and converted color signals each being obtained by subtracting, from each of the luminance extended color signals, a corrected minimum luminance value obtained by multiplying the minimum luminance value by a coefficient k; and a W (white) calculating section that outputs the minimum luminance value as a W (white) color signal for the W (white) picture element, wherein the coefficient k is set so that a luminance of the W (white) color signal becomes equal to or less than a minimum luminance of the luminance extended and converted color signals of the three colors.

According to these unique arrangements, a minimum luminance value is assumed to be a W (white) color signal for a W (white) picture element. The luminance extended and converted color signals are outputted for an R (red) picture element, a G (green) picture element, and a B (blue) picture element. Each of the luminance extended and converted color signals is obtained by subtracting, from each of the luminance extended color signals, a corrected minimum luminance value obtained by multiplying the minimum luminance value by a coefficient k. Accordingly, four color signals including the W (white) color signal and the luminance extended and converted color signals are generated from three color signals and outputted. This allows for improvement in the luminance by adding the W (white) signal, and at the same time, allows for prevention of reduction in color saturation of each reproduced color, which reduction is caused by the luminance extended and converted color signals. As a result, display quality can be improved.

Moreover, according to these unique arrangements, each of the three color signals previously subjected to luminance extension is subjected to luminance compression in accordance with a luminance of a preceding frame. Therefore, by varying a compression ratio in accordance with a scene corresponding to a preceding frame in image display, it becomes possible to perform optimum luminance extension in accordance with a scene of an image. This allows luminances of primitive colors to be extended to a certain extent. This provides an advantage that reduction in color saturation of a primitive color can be suppressed to a minimum even in a case where the primitive color comes adjacent to white color. As a result, display quality can be improved.

Furthermore, in the arrangement, the coefficient k is set so that the luminance of the W (white) color becomes equal to or less than a minimum luminance of the luminance extended and converted signals of the three colors. The coefficient k is used to obtain a corrected minimum luminance value by multiplying the minimum luminance value by the coefficient k. This allows for prevention of the occurrence of a white spot particularly during gray display and to improve display quality.

In the display apparatus, the coefficient k may be set so that an increase, caused by extension with the luminance extending rate S, in each of the luminance extended color signals are cancelled when the ratio t is equal to about 1, for example. According to the arrangement, luminance levels of an R (red) picture element, a G (green) picture element, and a B (blue) picture element can be equal to each other. This allows for prevention of the occurrence of a white spot particularly during gray display. As a result, display quality can be improved.

The display apparatuses according to preferred embodiments of the present invention may be arranged such that each of the R (red) picture element, the G (green) picture element, and the B (blue) picture element includes a corresponding color filter; the light emitting efficiencies are an average transmittance ratio (Tc) of the color filters, and a transmittance ratio (Tw) of the W (white) picture element; the function F(t) is set by a maximum luminance extending rate m ((3Tc+Tw)/3Tc) obtained on the basis of the average transmittance ratio (Tc) and the transmittance ratio (Tw); and the coefficient k is set by (Tw/3Tc).

In the display apparatuses according to preferred embodiments of the present invention, it is preferable that the function F(t) is set so that $F(t+\Delta t) > \{F(t)+F(t+2\Delta t)\}/2$, where $F(1)=m$. It is also preferable that the function F(t) has a relationship $F(t) < F(t+\Delta t) < \{F(t)+F(t+2\Delta t)\}$.

According to the unique arrangements of preferred embodiments of the present invention, the function F(t) indicating a luminance extending rate S is set to be $F(t+\Delta t) > \{F(t)+F(t+2\Delta t)\}/2$. This allows the function F(t) to be a concave function showing monotone increase. This makes it possible to prevent a curve of the luminance extending rate S from being bent in a similar manner to a curve of a conventional luminance extending rate S. As a result, it becomes possible to prevent the occurrence of a pattern where an image looks unnatural due to a turned curve. As a result, display image can be improved.

In the display apparatuses according to preferred embodiments of the present invention, a compression ratio in the luminance compressing section is preferably expressed by C/1.35, where C may be set to vary in a range from about 1.0 to about 1.35 in accordance with a luminance of an image signal in a preceding frame.

In the display apparatuses according to preferred embodiments of the present invention, it is preferable that the luminance extending section includes a predetermined maximum luminance level, and if there is a signal of a picture element whose luminance level is beyond the maximum luminance level among the luminance extended and converted color signals of the three colors, the luminance extending section outputs the signal with the luminance level replaced with the maximum luminance level; and the luminance extending section further includes a counter that counts the number of picture elements whose luminance levels are replaced by the maximum luminance level in one frame and adjusts a compression ratio to be applied in a subsequent frame in accordance with the number of the picture elements counted.

In the display apparatuses according to preferred embodiments of the present invention, it is preferable that the luminance extending section determines, for each color, whether or not each of the luminance extended and converted color signals of the three colors is beyond the maximum luminance level.

According to this unique arrangement, an RGB luminance compression ratio is determined according to luminance information for each color. Accordingly, the optimum luminance compression ratio can be calculated in accordance with a scene. By performing luminance extension at the luminance compression ratio thus calculated, it becomes possible to perform an optimum luminance extension in accordance with the scene.

The display apparatuses according to preferred embodiments of the present invention may be arranged such that the counter decreases C when the number of picture elements whose luminance level is beyond the maximum luminance level is larger than a predetermined value in any of the three colors, whereas the counter increases C when the number of picture elements whose luminance level is beyond the maximum luminance level is zero in all of the three colors.

A display apparatus according to various preferred embodiments of the present invention is capable of sharpening an image display by improving luminance while suppressing a change in a hue of color display. Accordingly, preferred embodiments of the present invention can be preferably applied to a field of an image display such as a color liquid crystal display apparatus.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A display apparatus for displaying an image with the use of a plurality of pixels arranged in a matrix, each of the pixels including four color picture elements including a red picture element, a green picture element, a blue picture element, and a white picture element, the display apparatus comprising:

a luminance compressing section arranged to generate and output compressed color signals which are obtained by respectively compressing luminances of incoming three color signals, red, green, and blue, in accordance with a luminance of a preceding frame;

a luminance extending section arranged to (i) generate luminance extended color signals by respectively extending luminances of the compressed color signals at a luminance extending rate S obtained on the basis of a function F(t) having a ratio t ($0 \leqq t \leqq 1$) as a variable, where the ratio t is a ratio of a minimum luminance value to a maximum luminance value in the compressed color signals, and (ii) output luminance extended and converted color signals of the three colors, the luminance extended and converted color signals each being obtained by subtracting, from each of the luminance extended color signals, a corrected minimum luminance value obtained by multiplying the minimum luminance value by a coefficient k; and a white calculating section arranged to output the minimum luminance value as a white color signal for the white picture element; wherein the coefficient k is set so that a luminance of the white color signal is equal to or less than a minimum luminance of the luminance extended and converted color signals of the three colors.

2. The display apparatus as set forth in claim 1, wherein the coefficient k is set so that an increase, caused by extension with the luminance extending rate S, in each of the luminance extended color signals is cancelled when the ratio t is equal to approximately 1.

3. The display apparatus as set forth in claim 1, wherein:

the function F(t) has a constant in accordance with light emitting efficiencies of the red picture element, the green picture element, the blue picture element, and the white picture element;

each of the red picture element, the green picture element, and the blue picture element includes a corresponding color filter;

the light emitting efficiencies are an average transmittance ratio (Tc) of the color filters, and a transmittance ratio (Tw) of the W white picture element;

the function F(t) is set by a maximum luminance extending rate m ((3Tc+Tw)/3Tc) obtained on the basis of the average transmittance ratio (Tc) and the transmittance ratio (Tw); and the coefficient k is set by (Tw/3Tc).

4. The display apparatus as set forth in claim 3, wherein the function F(t) is set so that $F(t+\Delta t)>\{F(t)+F(t+2\Delta t)\}/2$, where $F(1)=m$.

5. The display apparatus as set forth in claim 1, wherein a compression ratio in the luminance compressing section is expressed by C/1.35, where is set to vary in a range from about 1.0 to about 1.35 in accordance with a luminance of an image signal in a preceding frame.

6. The display apparatus as set forth in claim 5, wherein:

the luminance extending section includes a predetermined maximum luminance level, and if there is a signal of a picture element whose luminance level is beyond the maximum luminance level among the luminance extended and converted color signals of the three colors, the luminance extending section outputs the signal with the luminance level replaced with the maximum luminance level; and the luminance extending section further includes a counter that counts the number of picture elements whose luminance levels are replaced by the maximum luminance level in one frame and adjusts a compression ratio to be applied in a subsequent frame in accordance with the number of the picture elements counted.

7. The display apparatus as set forth in claim 6, wherein the luminance extending section determines, for each color, whether or not each of the luminance extended and converted color signals of the three colors is beyond the maximum luminance level.

8. The display apparatus as set forth in claim 7, wherein the counter decreases C when the number of picture elements whose luminance level is beyond the maximum luminance level is larger than a predetermined value in any of the three colors, and the counter increases C when the number of picture elements whose luminance level is beyond the maximum luminance level is zero in all of the three colors.

9. A display apparatus for displaying an image with the use of a plurality of pixels arranged in a matrix, each of the pixels including four color picture elements including a red picture element, a green picture element, a blue picture element, and a white picture element, the display apparatus comprising:

a luminance compressing section arranged to generate and output compressed color signals which are obtained by respectively compressing luminances of incoming three color signals, red, green, and blue, in accordance with a luminance of a preceding frame;

a determination section arranged to determine a ratio t having a value of $0 \leqq t \leqq 1$ and that is a ratio of a minimum luminance value to a maximum luminance value in the compressed color signals;

a luminance extending section arranged to (i) generate luminance extended color signals by respectively extending luminances of the compressed color signals at a luminance extending rate S obtained on the basis of a function F(t) having the ratio t as a variable, and (ii) output luminance extended and converted color signals of the three colors, the luminance extended and converted color signals each being obtained by subtracting, from each of the luminance extended color signals, a corrected minimum luminance value obtained by multiplying the minimum luminance value by a coefficient k; and a white calculating section that outputs the minimum luminance value as a white color signal for the white picture element; wherein the coefficient k is set so that a luminance of the white color signal is equal to or less than a minimum luminance of the luminance extended and converted color signals of the three colors.

10. The display apparatus as set forth in claim 9, wherein the coefficient k is set so that an increase, caused by extension with the luminance extending rate S, in each of the luminance extended color signals is cancelled when the ratio t is equal to approximately 1.

11. The display apparatus as set forth in claim 9, wherein:

the function F(t) has a constant in accordance with light emitting efficiencies of the red picture element, the green picture element, the blue picture element, and the white picture element;

each of the red picture element, the green picture element, and the blue picture element includes a corresponding color filter;

the light emitting efficiencies are an average transmittance ratio (Tc) of the color filters, and a transmittance ratio (Tw) of the W white picture element;

the function F(t) is set by a maximum luminance extending rate m ((3Tc+Tw)/3Tc) obtained on the basis of the average transmittance ratio (Tc) and the transmittance ratio (Tw); and the coefficient k is set by (Tw/3Tc).

12. The display apparatus as set forth in claim 11, wherein the function F(t) is set so that $F(t+\Delta t) > \{F(t)+F(t+2\Delta t)\}/2$, where $F(1)=m$.

13. The display apparatus as set forth in claim 9, wherein a compression ratio in the luminance compressing section is expressed by C/1.35, where C is set to vary in a range from about 1.0 to about 1.35 in accordance with a luminance of an image signal in a preceding frame.

14. The display apparatus as set forth in claim 13, wherein:

the luminance extending section includes a predetermined maximum luminance level, and if there is a signal of a picture element whose luminance level is beyond the maximum luminance level among the luminance extended and converted color signals of the three colors, the luminance extending section outputs the signal with the luminance level replaced with the maximum luminance level; and the luminance extending section further includes a counter that counts the number of picture elements whose luminance levels are replaced by the maximum luminance level in one frame and adjusts a compression ratio to be applied in a subsequent frame in accordance with the number of the picture elements counted.

15. The display apparatus as set forth in claim 14, wherein the luminance extending section determines, for each color, whether or not each of the luminance extended and converted color signals of the three colors is beyond the maximum luminance level.

16. The display apparatus as set forth in claim 15, wherein the counter decreases C when the number of picture elements whose luminance level is beyond the maximum luminance level is larger than a predetermined value in any of the three colors, and the counter increases C when the number of picture elements whose luminance level is beyond the maximum luminance level is zero in all of the three colors.

* * * * *